C5192 OR 4,545,817

United States Patent [19]

Bilek et al.

[11] Patent Number: 4,545,817

[45] Date of Patent: Oct. 8, 1985

[54] ALLOY USEFUL FOR PRODUCING DUCTILE AND COMPACTED GRAPHITE CAST IRONS

[75] Inventors: Paul J. Bilek, Danbury, Conn.; Richard A. Flinn, Ann Arbor, Mich.; Thomas K. McCluhan, N. Tonawanda, N.Y.; Paul K. Trojan, Ann Arbor, Mich.

[73] Assignee: Elkem Metals Company, Pittsburgh, Pa.

[21] Appl. No.: 598,241

[22] Filed: Apr. 9, 1984

Related U.S. Application Data

[62] Division of Ser. No. 362,866, Mar. 29, 1982, Pat. No. 4,472,197.

[51] Int. Cl.[4] ..... C22C 37/10

[52] U.S. Cl. ..... 75/123 E; 75/123 CB; 75/123 L; 75/130 A

[58] Field of Search ..... 75/123 CB, 123 L, 123 E, 75/130 A; 148/35

[56] References Cited

U.S. PATENT DOCUMENTS

| | | | |
|---|---|---|---|
| 2,622,022 | 12/1952 | Crome | 75/123 CB |
| 2,792,300 | 5/1957 | Livingston | 75/130 R |
| 2,973,564 | 3/1961 | Dixon et al. | 75/130 A |
| 4,086,086 | 4/1978 | Dawson et al. | 75/123 E |
| 4,147,533 | 4/1979 | Flinn et al. | 75/130 R |
| 4,396,428 | 8/1983 | Linebarger | 75/130 A |
| 4,459,154 | 7/1984 | Wells, III et al. | 75/123 L |

OTHER PUBLICATIONS

R. Clark and T. K. McCluhan, "Influence of Magnesium Content on the Nodularizing Efficiency of Magnesium-Ferrosilicon Alloys", *Tran. of American Foundrymens Society*, pp. 442–445, vol. 73, 1965.

P. J. Guichelaar, "Equilibrium Immiscibility Relations in the Iron-Magnesium-Silicon Ternary Liquid System", A dissertation submitted in partial fulfillment of the requirements for the degree of Doctor of Philosophy in the U. of Michigan, 1969.

P. J. Guichelaar, P. K. Trojan, T. K. McCluhan, R. A. Flinn, "A New Technique for Vapor Pressure Measurement Applied to the Fe-Si-Mg System", *Metallurgical Transactions*, vol. 2, No. 12, Dec. 1971.

P. K. Trojan and R. A. Flinn, "Ductile Iron Research Builds a Better Trap for Elusive Magnesium," *Society of Automotive Engineers Journal*, Apr., 1964, pp. 60–61.

P. K. Trojan, "Liquid-Liquid Equilibria and Thermodynamic Data for the Fe-C-Si-Mg System", *Thesis for the Univ. of Michigan*, 1961.

P. K. Trojan and R. A. Flinn, "A New Method for Determination of Liquid-Liquid Equilibrium as Applied to the Fe-C-Si-Mg System", *Trans. of American Society for Metals*, vol. 54, No. 3, 1961.

*Primary Examiner*—L. Dewayne Rutledge
*Assistant Examiner*—Deborah Yee
*Attorney, Agent, or Firm*—Lucas & Just

[57] ABSTRACT

The present invention is directed to an alloy composition and the method of treating molten cast iron with such alloy to produce ductile and compacted graphite cast irons. The alloy may contain about 0.1% to about 10% silicon, about 0.05 to about 2.0% cerium and/or other rare earth elements, about 0.5 to about 4% magnesium, about 0.5 to about 6.5% carbon (percent by weight) the balance being iron.

10 Claims, No Drawings

T6012E
X60240
X6081W

ALLOY USEFUL FOR PRODUCING DUCTILE AND COMPACTED GRAPHITE CAST IRONS

This is a division of application Ser. No. 362,866, filed Mar. 29, 1982, now U.S. Pat. No. 4472197.

This invention relates to an alloy of exceptional utility for producing ductile cast iron or compacted graphite cast irons and the process of treating cast iron with said alloy. The alloy comprises a low silicon, low magnesium predominately iron alloy containing rare earth elements such as cerium as the essential elements.

It is known to introduce magnesium in controlled quantities into a melt of ordinary gray cast iron in order to cause the carbon to solidify in a spheroidal form and thereby produce ductile cast iron with greatly improved tensile strength and ductility over that exhibited by ordinary cast iron. The amount of magnesium retained in the melt for this purpose varies but in general will range from about 0.02% to about 0.08% magnesium by weight of iron depending on the composition of the iron melt at hand.

Compacted graphite cast iron, also known as vermicular graphite iron is also produced by addition of magnesium. In this case the carbon precipitates in a form more rounded and somewhat chunky and stubby as compared to normal flake graphite commonly found in gray cast iron. The amount of magnesium retained in the molten iron is carefully controlled to provide from about 0.015% to about 0.035% magnesium by weight of iron and again the exact amount depends on the particular composition of the molten iron and other known foundry variables. In general, compacted graphite cast iron has a measure of the strength characteristics of ductile iron and possesses greater thermal conductivity and resistance to thermal shock.

The production of ductile cast iron and compacted graphite cast irons is well known and as is known, difficulties are encountered by virtue of the pyrotechnics that occur when magnesium is added to molten iron. The molten iron bath fumes, smokes and flares with resulting uneconomical loss of magnesium, air pollution and difficulty in controlling the addition of measured amounts of magnesium to the molten iron for the desired result.

These problems exist when a conventional ferrosilicon alloy containing five percent or more of magnesium is used. (U.S. Pat. Nos. 3,177,071; 3,367,771 and 3,375,104). Suggestions have been made to overcome the drawback of the magnesium ferrosilicon alloys by using high nickel alloys (U.S. Pat. Nos. 3,030,205; 3,544,312); by using coke or charcoal impregnated with magnesium (U.S. Pat. Nos. 3,321,304; 3,598,572; 4,003,424); or by using briquettes and compacted particulate metals (U.S. Pat. Nos. 3,290,142; 4,309,216 and UK Pat. Nos. 1,397,600; 2,066,297).

High nickel alloys are expensive and are not generally used except in those limited circumstances where a high nickel cast iron is desired. Coke and charcoal impregnated with magnesium and briquettes and compacted particular metals can assist somewhat in solving the pyrotechnical problem but these materials require special handling techniques and apparatus which only serve to increase cost and add to the requirement for sophisticated controls.

Mechanical approaches have also been used wherein a magnesium composition is introduced below the surface of the molten iron bath (U.S. Pat. Nos. 2,869,857; 3,080,228; 3,157,492; 3,285,739; 4,147,533; 4,166,738). While this is of help, substantial quantities of magnesium are nevertheless lost to the atmosphere and in many cases the added steps incident to the mechanical approach do not adequately compensate for the loss of magnesium.

In accordance with the present invention, an alloy of exceptional utility has been devised for producing ductile and compacted graphite cast irons which makes it possible to virtually eliminate the pyrotechnical problem heretofore experienced in the art. Moreover, the alloy of this invention provides a high recovery of magnesium and greater flexibility in the procedures employed for manufacturing ductile and compacted cast irons. Essentially the alloy may contain from about 0.1 to about 10.0% silicon, about 0.05 to about 2.0% cerium and/or one or more other rare earth elements, about 0.5 to about 4.0% magnesium, about 0.5 to about 6.5% carbon. All percentages are based on the weight of the alloy, the balance being iron. The alloy may contain small amounts of other elements such as calcium, barium or strontium and trace elements conventionally present in the raw materials used in producing the alloy will also be present.

The very low amount of silicon in the alloy is of particular advantage in that scrap metals of relatively high silicon content may be used in the cast iron melt, and thereby provide the final product with a commercially acceptable level of silicon. Excess silicon in the final ductile or compacted graphite cast iron tends to give the iron low impact characteristics which are undesirable in most applications. The low silicon content of the alloy of the present invention is of further advantage for increasing the density of the alloy which reduces the tendency to float with a concurrent reduction in pyrotechnics and increased recovery of magnesium in the molten iron. Conventional magnesium alloys containing twenty five and more percent by weight of silicon having a density of about 3.5 to about 4.5 gms/cm$^3$ do not give the advantages and flexibility of the low silicon alloy of the present invention.

The low magnesium content of the alloy of this invention materially contributes to a high recovery of magnesium in the treated molten cast iron and a highly desirable reduction in pyrotechnics. The high and consistent recoveries resulting from the low magnesium content of the alloy also facilitates control of the amount of magnesium retained in the melt which assists in providing the proper amount of magnesium within the narrow range required to produce compacted graphite cast irons.

The cerium and/or other rare earth elements content of the alloy is essential to counteract the deleterious effect of tramp elements such as lead, bismuth, titanium and antimony which tend to inhibit nodulization of graphite that precipitates from the melt for production of ductile cast iron. The cerium and/or other rare earth elements are also important for their nucleating and nodulizing effects in the melt and tendency to reduce the formation of undesirable carbides in ductile cast iron. Cerium is the preferred rare earth element.

Best results are achieved when the density of the alloy of the present invention is from about 6.5 to about 7.5 gms./cm$^3$ and contains from about 1.0 to about 6% silicon, about 0.2 to 2.0% cerium and/or one or more rare earth elements, about 0.9 to 2.0% magnesium, about 3.0 to about 6.0% carbon (by weight of alloy), the balance being iron containing small amounts of other elements as described herein above. Within the specified range of density, there is a reduced tendency for the alloy to float on the surface of the treated molten cast iron which in general has a density of about 6.0 to 6.5 gms/cm$^3$ depending on composition and temperature. This is of advantage to reduce pyrotechnics and increase recovery of magnesium in the melt.

The alloy of the present invention may be made in conventional manner with conventional raw materials known in the art. In a preferred procedure, the vessel in which the alloy is formed is held under the pressure of an inert gas such as argon at about 50 to 75 p.s.i.g. Conventionally available magnesium scrap, magnesium silicide, and magnesium metal may be used in forming the alloy. The rare earth elements may be introduced as elements per se into the alloy, or mischmetal may be employed, or cerium metal, or cerium silicides may be used. Silicon metal, ferrosilicon, silicon carbide, carbon, and ordinary pig iron or steel scrap may be used in producing the alloy. The amounts of raw materials are controlled in known manner to form an alloy within the specified range of elements. Best results are achieved by rapid solidification of the alloy melt.

In one example, the alloy of the present invention was produced by charging 572.0 grams of CSF No. 10 (Foote Mineral), and 88 grams of magnesium metal, and iron, into a vessel and heating to 1300° C. while held under argon gas pressure of 60 p.s.i.g. The melt was held for three minutes and the total charge of 6000 grams was thereupon rapidly solidified as by a chill mold technique. The resulting iron alloy by analysis contained 1.24% by weight of magnesium and 0.97% by weight of cerium and a low silicon content within the specified range. The CSF No. 10 is the trade name of Foote Minerals Company for an iron alloy containing about 38% silicon, about 10% cerium and about 2% other rare earth elements (total 12% rare earth elements) by weight, the balance of the alloy being iron.

The procedure of Example 1 was again used to produce the low silicon predominately iron alloy of the present invention using a total charge of 6000 grams containing iron and the following added materials.

| Charge in Grams | | Alloy Analysis | |
|---|---|---|---|
| CSF 10 | Mg | % Mg | % Ce |
| 450 | 90 | 1.17 | 0.66 |
| 300 | 90 | 1.04 | 0.48 |

As a result of rapid solidification, the magnesium in the alloy of the present invention is retained as a fine dispersion or separate phase within the iron-carbon silicon matrix. Since the magnesium exists as a fine dispersion in the alloy, the interaction between the magnesium and the molten cast iron being treated in the foundry takes place at a multitude of locations. The advantage of such a dissolution of magnesium in the foundry melt is that a higher recovery of magnesium in the treated cast iron is achieved as compared to conventional magnesium ferrosilicon alloys.

Any desired procedure may be used in treating molten cast iron with the alloy of the present invention to produce ductile or compacted graphite cast irons such as the known sandwich method, pour-over technique, positioning the alloy within a reaction chamber inside the mold, adding the alloy to a stream of molten cast iron or to a bath of molten cast iron in a furnace or foundry ladle. The alloy may be introduced into the molten cast iron to be treated in molten form under pressure or solid particulate form or as bars or ingots and the like depending on the foundry process at hand. The amount of alloy added to the cast iron to be treated may be varied in known manner depending on the selected composition for the final product. In general, the amount of alloy added to molten cast iron is sufficient to retain from about 0.015 to 0.035% magnesium by weight of the treated iron to produce compacted graphite cast irons and from about 0.02% to about 0.08% by weight for ductile iron with nodular carbon. The exact level of magnesium in the treated molten iron may be determined by conventional foundry analysis. Because of the high magnesium recovery obtained by the alloy of the present invention in the treated metal, a smaller amount of the magnesium may be added to achieve the selected composition for the final product as compared to the customary alloys conventionally used. For example, 38.0 kilograms of conventional foundry cast iron was treated with the alloy of the present invention to produce ductile cast iron by plunging the following particulate mixture beneath the surface of a molten iron bath at a temperature of 1525° C.:

| Alloy | Elemental % by Weight | | | | | Amount in Mix |
|---|---|---|---|---|---|---|
| Heat No. | Mg | Ce | C | Si | Fe | Grams |
| 214 | 1.34 | 0.65 | 3.22 | 4.60 | Remainder | 902 |
| 216 | 1.32 | 0.61 | 3.45 | 3.78 | Remainder | 902 |

The molten cast iron into which the above mixture was plunged contained 3.67% carbon, 2.01% silicon and 0.019% sulfur based on the weight of the cast iron. There were no deleterious pyrotechnics and when the reaction was deemed to be completed 7.0 kilograms of molten treated iron were tapped into a foundry ladle. The 7.0 kilograms were inoculated in conventional manner by stirring in foundry grade 75% ferrosilicon in an amount sufficient to being the silicon content of the treated molten iron up to about 2.5% by weight.

A sample of the resulting ductile iron, after complete dissolution of the ferrosilicon, was analyzed to determine the percent by weight of magnesium, silicon and cerium and the percent by weight of magnesium recovered in the treated molten iron compared to the magnesium input from the alloy used in treating the iron as follows:

| | Alloy Input | | Iron Analysis | | |
|---|---|---|---|---|---|
| Heat | % Mg | % Si | % Mg | % Si | % Mg Recovered |
| J 882 | 0.06 | 0.2 | 0.038 | 2.51 | 63 |

Recovery in the molten iron of 63% by weight of the magnesium available in the alloy is exceptional as compared to a recovery of only about 22% to 28% magnesium from a magnesium ferrosilicon alloy containing 5% magnesium when the molten iron was treated in the same manner. In addition, one would expect an increase in the silicon content of the molten iron on the order of about 1.2% resulting from use of conventional magnesium ferrosilicon alloys.

A quantitative metallographic analysis of the polished surface of fins cut from a cast specimen of the melt was as follows:

| Fin Thickness (Cm) | % Nodularity | Nodules/mm$^2$ |
|---|---|---|
| 0.6 | 91 | 351 |
| 1.9 | 85 | 236 |

The percent nodularity and nodule count were as expected for ductile iron castings.

Additional examples of iron alloys made in accordance with the present invention had the following chemical analyses of essential elements, in percent by weight:

| | Elemental % by Weight | | | | |
|---|---|---|---|---|---|
| Alloy | Mg | Ce | C | Si | Fe |
| Run 177 | 1.23 | 0.51 | 3.32 | 5.72 | Balance |
| Run 178 | 1.34 | 0.86 | 2.86 | 7.16 | Balance |
| Run 178 | 1.22 | 0.48 | 4.25 | 2.45 | Balance |
| Run 180 | 1.48 | 0.85 | 4.06 | 3.76 | Balance |

In all cases the alloys contained small amounts of other elements.

The foregoing alloys were used in treating molten iron containing the following essential elements in percent by weight and small amounts of other elements conventionally present in iron:

| | Elemental % by Weight | | | | |
|---|---|---|---|---|---|
| Heat | C | Si | Mn | S | Fe |
| J 694 | 3.42 | 2.11 | 0.52 | 0.011 | Balance |
| J 695 | 3.76 | 2.11 | 0.53 | 0.009 | Balance |
| J 696 | 3.78 | 2.16 | 0.52 | 0.010 | Balance |
| J 697 | 3.86 | 2.17 | 0.53 | 0.010 | Balance |

The treatment was carried out by pouring molten iron at a temperature of 1525° C. over a preweighed quantity of alloy lying in a treatment pocket at the bottom of a foundry ladle. After the reaction had subsided, seven kilograms molten cast iron were transferred to a 10 kg capacity clay graphite crucible. When the temperature of the molten iron in that crucible dropped to 1350° C., a foundry grade 75% ferrosilicon was stirred into the bath as a post inoculant in an amount sufficient to increase the silicon content of molten iron to about 2.7% by weight. Samples of iron were taken from the melt for analysis and specimen castings with fins 0.6 cm and 1.9 cm thick were poured after the temperature of the treated metal had dropped to 1325° C.

The weight of alloy used in treating the molten iron was in each case calculated for a selected percent of input of magnesium based on the weight of molten iron to be treated. The molten iron treated with the following input of magnesium contained the following essential elements in percent by weight with the specified recovery of magnesium and cerium:

| | Alloy | % Mg | Treated Iron Analysis | | | | Recovered |
|---|---|---|---|---|---|---|---|
| Heat | Used | Input | % C | % Si | % Mg | % Ce | % Mg |
| J 694 | 177 | 0.060 | 3.56 | 2.70 | 0.048 | 0.033 | 80 |
| J 695 | 178 | 0.060 | 3.58 | 2.76 | 0.043 | 0.030 | 72 |
| J 696 | 179 | 0.060 | 3.56 | 2.12 | 0.042 | 0.023 | 70 |
| J 697 | 180 | 0.060 | 3.76 | 2.65 | 0.034 | 0.028 | 57 |

A quantitative metallographic analysis of the polished surface of fins cut from a cast specimen of the melt was as follows:

| Heat | Fin Thickness cm | % Nodularity | Nodules/ mm$^2$ |
|---|---|---|---|
| J 694 | 0.6 cm | 93 | 458 |
| J 694 | 1.9 cm | 90 | 224 |
| J 695 | 0.6 cm | 92 | 369 |
| J 695 | 1.9 cm | 85 | 170 |
| J 696 | 0.6 cm | 94 | 449 |
| J 696 | 1.9 cm | 82 | 186 |
| J 697 | 0.6 cm | 91 | 430 |
| J 697 | 1.9 cm | 80 | 141 |

As is conventional in the art, the treated molten cast iron may be inoculated with a ferrosilicon composition to reduce the formation of iron carbides (U.S. Pat. No. 4,224,064). If desired for a particular ductile or compacted graphite cast iron composition, one or more other metals may be incorporated into the alloy of the present invention which in some cases may be of advantage to avoid the separate addition of such metals to the molten cast iron. One or more other metals which may have a desired effect with respect to the formation of ductile or compacted graphite cast irons or a desired effect on the physical properties of the final product may also be incorporated into the alloy of the present invention.

It will be understood that it is intended to cover all changes and modifications of the preferred form of invention herein chosen for the purpose of illustration which do not depart from the spirit and scope of the invention.

What is claimed is:

1. An iron alloy for treating molten iron containing carbon to produce ductile cast iron containing nodular carbon, or compacted graphite cast iron, said iron alloy comprising by weight from about 0.1 to about 10.0% silicon, about 0.05 to about 2.0% of one or more rare earth elements, about 0.5 to about 4.0% magnesium, about 0.5 to about 6.5% carbon, the balance of the alloy being iron.

2. An alloy for treating molten iron containing carbon to produce ductile cast iron containing nodular carbon or compacted graphite cast iron, said alloy being predominately iron having as essential elements by weight from about 3.0 to about 6.0% silicon, about 0.2 to about 2.0% rare earth elements predominately cerium, and about 0.9 to about 2.0% magnesium.

3. The alloy of claim 2 having density from about 6.5 to about 7.5 gms/cm$^3$.

4. The method of making an alloy for treating molten iron containing carbon to produce ductile or compacted graphite cast irons which comprises the steps of forming a molten iron bath comprising by weight from about 0.1 to about 10.0% silicon, about 0.05 to about 2.0% one or more rare earth elements, about 0.5 to about 4.0% magnesium, about 0.5 to about 6.5% carbon, the balance being iron and maintaining said molten bath under superatmospheric pressure of an inert gas while reaction takes place and then rapidly solidifying the melt to form the iron alloy.

5. The method of making an alloy for treating molten iron containing carbon to produce ductile or compacted graphite cast irons which comprises the steps of forming a molten iron bath comprising by weight from about 3.0 to about 6.0% silicon, about 0.2 to about 2.0% rare earth elements predominately cerium, about 0.9 to about 2.0% magnesium, about 3.0 to about 6.0% carbon, the balance being iron, maintaining said molten bath under from about 50 to about 75 p.s.i.g. pressure of an inert gas while reaction takes place and adjusting the proportions of said metals to produce the iron alloy with density from about 6.5 to about 7.5 gms/cm$^3$.

6. The iron alloy of claim 1 wherein said alloy is used for treating molten bath of metal.

7. The iron alloy of claim 2 wherein said alloy is used for treating molten bath of metal.

8. The iron alloy of claim 3 wherein said alloy is used for treating molten bath of metal.

9. The iron alloy of claim 4 wherein said alloy is used for treating molten bath of metal.

10. The iron alloy of claim 5 wherein said alloy is used for treating molten bath of metal.

* * * * *